US009571918B2

(12) United States Patent
Giannuzzi

(10) Patent No.: US 9,571,918 B2
(45) Date of Patent: Feb. 14, 2017

(54) AUDIO SIGNAL OUTPUT DEVICE AND METHOD OF PROCESSING AN AUDIO SIGNAL

(75) Inventor: Joseph Mario Giannuzzi, Cedar Park, TX (US)

(73) Assignee: RAZER (ASIA-PACIFIC) PTE. LTD., Singapore (SG)

( * ) Notice: Subject to any disclaimer, the term of this patent is extended or adjusted under 35 U.S.C. 154(b) by 80 days.

(21) Appl. No.: 14/411,966

(22) PCT Filed: Jul. 13, 2012

(86) PCT No.: PCT/US2012/046588

§ 371 (c)(1),
(2), (4) Date: Dec. 30, 2014

(87) PCT Pub. No.: WO2014/011183

PCT Pub. Date: Jan. 16, 2014

(65) Prior Publication Data

US 2015/0189423 A1 Jul. 2, 2015

(51) Int. Cl.

*H04R 1/10* (2006.01)
*H04S 7/00* (2006.01)
*H04R 17/02* (2006.01)

(52) U.S. Cl.

CPC ..... *H04R 1/1091* (2013.01); *H04R 17/02* (2013.01); *H04S 7/304* (2013.01); *H04R 1/1075* (2013.01);

(Continued)

(58) Field of Classification Search

CPC ..... H04S 7/301; H04S 7/304; H04S 2420/01; H04R 1/1075; H04R 1/1091; H04R 5/027; H04R 5/033; H04R 9/063; H04R 29/001; H04R 2205/022; H04R 2205/041; G10K 2210/1081; G10K 2210/30232; G10K 2210/3055

See application file for complete search history.

(56) References Cited

U.S. PATENT DOCUMENTS 5,481,615 A * 1/1996 Eatwell ..... G10K 11/1784 381/103
7,215,766 B2 * 5/2007 Wurtz ..... H04M 1/6058 379/420.04

(Continued)

FOREIGN PATENT DOCUMENTS

CN 101794574 A 8/2010
EP 1947904 A1 7/2008

(Continued)

OTHER PUBLICATIONS

"International Search Report and Written Opinion dated Nov. 26, 2012," International Application No. PCT/US2012/046588, 9 pages.

(Continued)

*Primary Examiner* — Duc Nguyen
*Assistant Examiner* — Kile Blair
(74) *Attorney, Agent, or Firm* — Polsinelli PC

(57) ABSTRACT

The present invention is a method of processing an audio signal comprising outputting a first part of a first audio signal; picking up the output first part of the first audio signal as a second audio signal; comparing a second part of the first audio signal and the second audio signal; modifying the second part of the first audio signal based on the result of the comparison; and outputting the modified second part of the first audio signal. An audio signal output device is also disclosed.

17 Claims, 7 Drawing Sheets

(52) U.S. Cl.
CPC ..... *H04R 2430/00* (2013.01); *H04S 2420/01* (2013.01)

(56) References Cited

U.S. PATENT DOCUMENTS

| | | | | |
|---|---|---|---|---|
| 7,391,876 | B2 * | 6/2008 | Cohen | H04S 1/005 381/17 |
| 2002/0003889 | A1 | 1/2002 | Fischer | |
| 2008/0037801 | A1 | 2/2008 | Alves et al. | |
| 2008/0107294 | A1 | 5/2008 | Burrows et al. | |
| 2008/0170725 | A1 | 7/2008 | Asada et al. | |
| 2009/0046867 | A1 * | 2/2009 | Clemow | G10K 11/1788 381/71.6 |
| 2009/0268931 | A1 | 10/2009 | Andrea et al. | |
| 2012/0155667 | A1 * | 6/2012 | Nair | G10K 11/178 381/71.6 |

FOREIGN PATENT DOCUMENTS

| | | | |
|---|---|---|---|
| EP | 2202998 | A1 | 6/2010 |
| WO | 2009/061223 | A2 | 5/2009 |
| WO | 2011110901 | A1 | 9/2011 |

OTHER PUBLICATIONS

"International Preliminary Report on Patentability dated Jan. 13, 2015," International Application No. PCT/US2012/046588, 8 pages.
First Office Action Issued Nov. 4, 2015 in Chinese Patent Application No. 201280074475.4.
Extended European Search Report mailed Apr. 14, 2016 for corresponding EP Patent Application No. 12880963.9.

* cited by examiner

AUDIO SIGNAL OUTPUT DEVICE AND METHOD OF PROCESSING AN AUDIO SIGNAL

TECHNICAL FIELD

Various embodiments generally relate to the field of audio signal processing, in particular, real-time adaptive audio head-related transfer function (HRTF) system.

BACKGROUND

Advances in digital signal processing (DSP) have led to a proliferation of hardware (HW) and software (SW) developments/solutions that have been applied to various audio systems ranging from traditional 2.1 up to virtual 7.1 audio systems including headphones/headsets. In particular, by taking advantage of these new DSP technologies to a great extent, there have been a significant number of changes in headphones/headsets. Users of headphones, headsets and ear buds are seeing virtualized 5.1 and 7.1 versions come to market. These expanded versions require a lot more audio/sound processing power to achieve audio (sonic) results desired, which closely approximate actual 5.1 and 7.1 sounds, and to achieve optimized audio for gaming purposes.

FIG. 1 shows a top view of a schematic diagram of a user 100 wearing a headphone (or headset) 102. The head-related transfer functions (HRTFs) at the right ear cup 104 and the left ear cup 106 of the headphone 102 are represented by $H_{RR}$ 108 and $H_{LL}$ 110, respectively which are used to denote the direct transmission or audio impulses that the right ear and the left ear would respectively perceive. Ideally, in a contained environment, there should be no crosstalk between the right ear cup 104 and the left ear cup 106, i.e., the HRTF from right to left ear cups ($H_{RL}$ 112) and the HRTF from left to right ear cups ($H_{LR}$ 114) are zero. The right ear cup 104 and the left ear cup 106 are independent from each other. However, it should be understood that in practice, audio signals may have inherent crosstalk that may affect the sound perceived by the user.

While advances in HRTF implementations have been realized, they are based on "fixed models" of implementations. This means that these implementations are not adaptive and do not take into account ambient noise or the physical aspect of a human listener's (or user's) ear(s). The listener's outer ear configuration or structure (or pinna) can compound the problem by way of applying an "amplification and/or attenuation factor", which is related to the human hearing sensitivity, to the incoming audio signature (or signal). FIG. 2 shows a schematic diagram of the listener's ear 200. The pinna 202 of the listener's ear 200 acts as a receiver for the incoming audio signal 204 through the auditory canal 206 into the tympanic membrane 208. Because of the spreading out of sound energy by inverse square law, a larger receiver, for example, a large pinna 202 picks up more energy, amplifying the human hearing sensitivity by a factor of about 2 or 3.

Due to the fixed nature of current HRTF implementations it is not possible to account for and adjust for the variables that are known to exist regardless of environment, for example, ambient noise, variability in size and shape of the outer/inner ear canals of a given listener, variable positions of the audio driver(s) in the headset, for example, the headset 102 of FIG. 1 in relation to the outer/inner ear canal.

Thus, there is a need to provide a method and apparatus for integration within audio devices such as headphones, headsets and ear buds a real-time adaptive audio adjustment system that would significantly improve the perceived sound quality; thereby seeking to address at least the above mentioned problems.

SUMMARY OF THE INVENTION

In a first aspect, the present invention relates to a method of processing an audio signal including outputting a first part of a first audio signal; picking up the output first part of the first audio signal as a second audio signal; comparing a second part of the first audio signal and the second audio signal; modifying the second part of the first audio signal based on the result of the comparison; and outputting the modified second part of the first audio signal.

According to a second aspect, the present invention relates to an audio signal output device including a speaker configured to output a first part of a first audio signal; a microphone configured to pick up the output first part of the first audio signal as a second audio signal; a comparator configured to compare a second part of the first audio signal and the second audio signal; and a circuit configured to modify the second part of the first audio signal based on the result of the comparison, wherein the speaker is further configured to output the modified second part of the first audio signal.

In a third aspect, the present invention relates to a headset including a pair of ear cups; a speaker or number of speakers located in each ear cup; and a microphone located within at least one of the pair of the ear cups, wherein the speaker is substantially centrally located with the ear cup; and wherein the microphone is located adjacent to the speaker.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. The dimensions of the various features/elements may be arbitrarily expanded or reduced for clarity. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

In order that the invention may be readily understood and put into practical effect, particular embodiments will now be described by way of examples and not limitations, and with reference to the figures.

Unique adaptations or implementations of head related transfer functions (HRTFs) continue to evolve. Various embodiments provide a combination (or refined combination) of existing DSP HW technologies combined with unique SW/algorithms that allows for a specific implementation. The way in which various HW and SW elements are arranged within the ear cups and integrated at the SW level allows the raw audio stream to be altered, i.e., modified by way of applying complex real-time signal processing of the audio signature that enters the listen's ears so as to enable the listening experience to be clearer (or more pure). By doing so, this ensures the perceived audio matches as closely as possible the original/raw audio stream as it is intended to be heard.

Various embodiments comprise a unique combination or blend of audio DSP technologies and microphone elements positioned in the ear pieces in such a way that the ear pieces pick up the right/left audio signatures altered by how the sound bounces off the outer ear canal and then a comparison of the original/raw audio source left and right channel is performed. The real time adaptive DSP technologies invoke and alter the original raw audio stream at the DSP level and ensure that the perceived sound signature, at the outer ear matches as closely as possible the original/raw audio stream.

Figure 3:
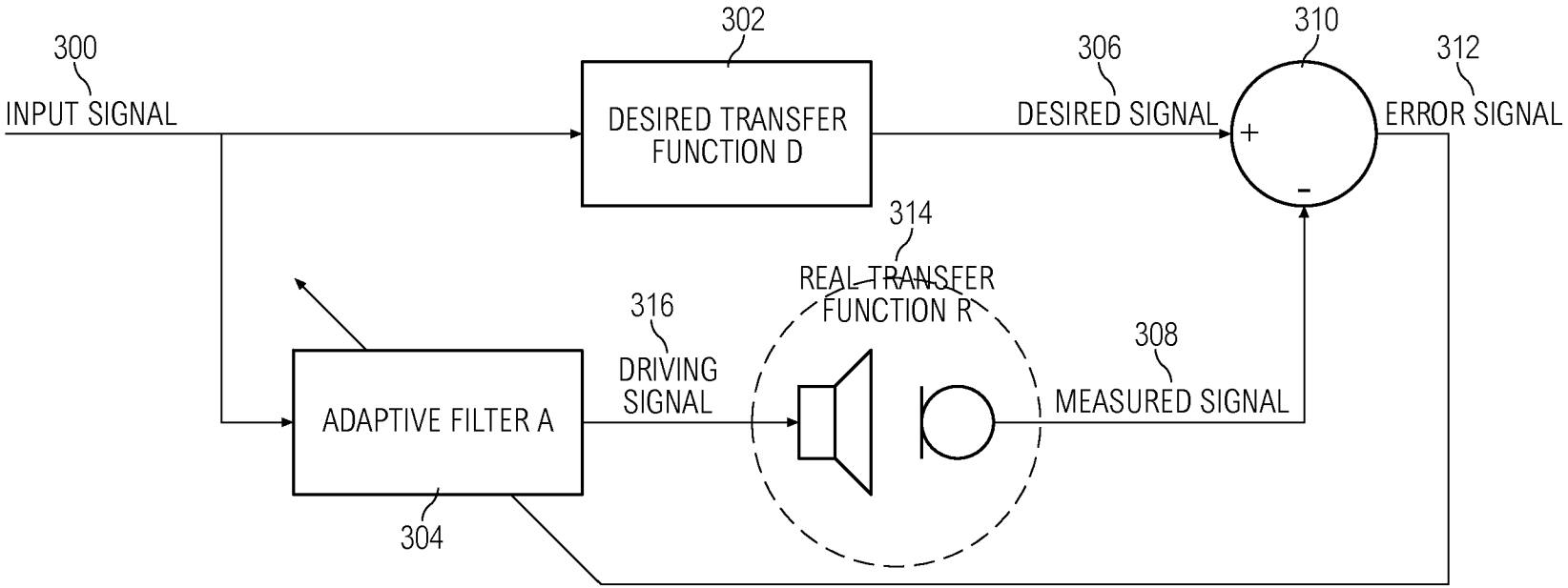
FIG. 3 shows a block diagram of an exemplary real-time adaptive inverse filtering process, in accordance to various embodiments.

Various embodiments provide frequency corrections on the original raw audio stream based on a unique HW driver in the ear cup of the headphone. Frequency corrections may be related to or associated with other algorithmic functions, for example, amplitude corrections (that is, amplification corrections or attenuation corrections) and phase shift corrections (or delay corrections). FIG. 3 shows a block diagram of an exemplary real-time adaptive inverse filtering process. In FIG. 3, an input signal 300 is fed into a desired transfer function D 302 and an adaptive filter A 304. The output from the desired transfer function D 302 is a desired signal 306 which is compared with a measured signal 308 by a comparator 310 to give an error signal 312. The measured signal 308 is obtained from the output of a real transfer function R 314 which accepts a driving signal 316 as its input. The driving signal 316 is in turn obtained from the output of the adaptive filter A 304, which has filtering parameters adapted in accordance to the error signal 312. The adaptive filter as seen in FIG. 3 is an example of a specific underlying algorithm for adaptively processing an audio signal in real-time.

In other words, for example, wave synthesis may be comparing a base line audio wave to a reflected audio wave from the microphones that are placed in each ear cup. The microphones may be placed at various locations in each ear cup. However, when placed at certain locations or strategic locations, the microphones can receive, for example, the maximum level of reflected audio wave; thereby enhancing the picking up of the desired audio signal for processing.

Wave synthesis may be applied in real time and is the process whereby, for example in FIG. 3, the raw or incoming audio wave is digitally sampled and then compared to a digital sample of the reflected audio wave from each ear cup. A third or audio wave results after the correction factors are applied, (i.e. amplification, attenuation, phase shift, delay, echo and/or noise cancellation). Wave synthesis applies the correction factors in real time and produces a third and unique audio wave that is reconstructed by applying the correction factor to as closely as possible approximate the initial or raw audio wave.

Figure 4:
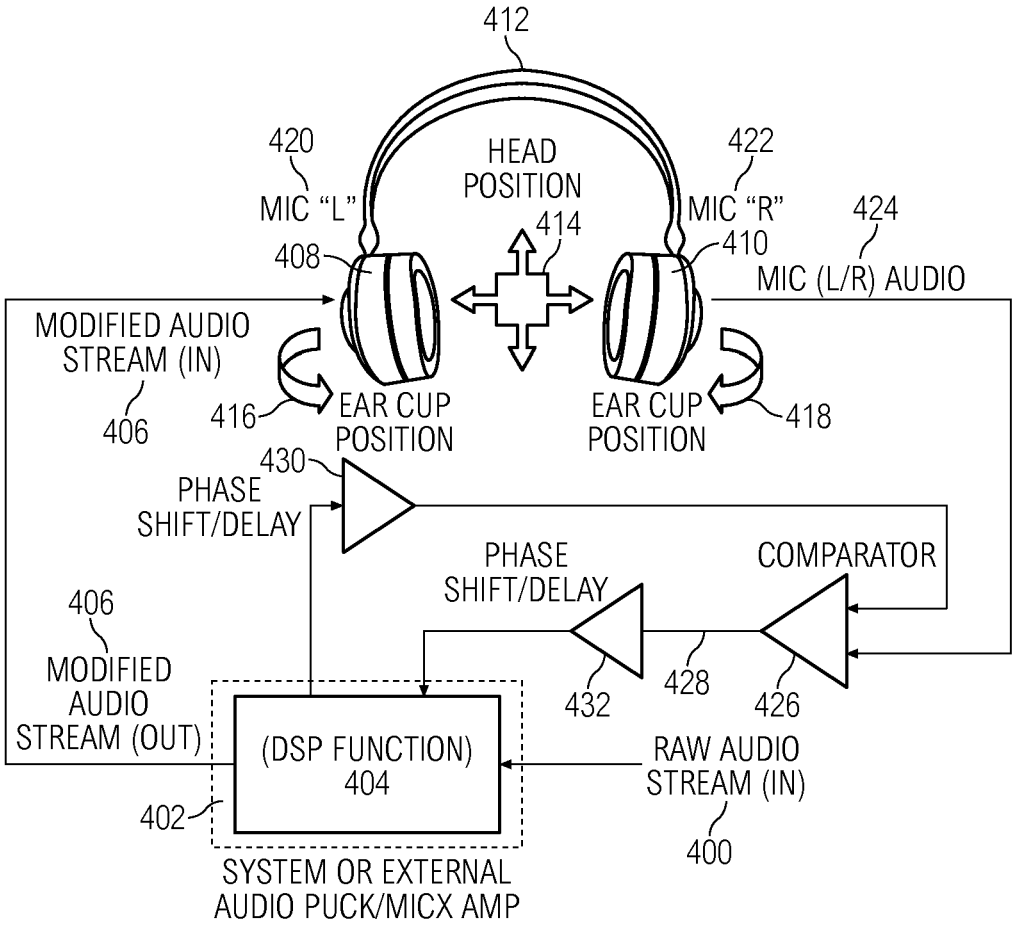
FIG. 4 shows an exemplary overview of a combination (or refined combination) of existing DSP HW technologies combined with unique SW/algorithms that allows for a specific implementation, in accordance to various embodiments.

FIG. 4 shows an exemplary overview of a combination (or refined combination) of existing DSP HW technologies combined with unique SW/algorithms that allows for a specific implementation.

In FIG. 4, a raw audio stream (or signal) 400 is input into a system 402 including a DSP function 404. The system 402 may be but is not limited to an external audio PUCK/MICX amplifier. The raw audio stream 400 may be modified by the DSP function 404 to a modified audio stream (or signal) 406, output by the system 402. The DSP function 404 may also be used to perform some amount of processing for changes in amplitude, attenuation and/or other signal anomalies such as echo and or noise cancellation. The modified audio stream 406 is then fed into the left and right ear cups 408, 410 of a headset 412. A user (not shown in FIG. 4) positions his/her head between the left and right ear cups 408, 410 as shown by a directional symbol 414. The ear cups 408, 410 may be positioned against the user's respective ears (not shown in FIG. 4) as shown by arrows 416, 418 respectively.

A microphone 420 (MIC "L") in the left ear cup 408 and a microphone 422 (MIC "R") in the right ear cup 410 respectively pick up a MIC (L/R) audio signal 424 that is fed back into a comparator 426. The comparator 426 also receives the raw audio stream 400 and compares this raw audio stream 400 and the MIC (L/R) audio signal 424. The comparator 426 outputs result(s) of the comparison 428 which is fed back into the system 402. The system 402 receives the result(s) 428 and modifies the raw audio stream 400 based on the results(s) 428.

In order for the comparator 426 to perform the comparison of the MIC (L/R) audio signal 424 with respect to the corresponding raw audio stream 400, a delay is introduced to the raw audio stream 400 by a phase shifter 430 before entering the comparator 426; thereby providing a form of timing synchronization between the two signals for comparison.

In order for the system 402 to perform the modification of the raw audio stream 400 based on the corresponding result(s) of the comparison 428, another delay is introduced to the result(s) of the comparison 428 by another phase shifter 432 before entering the system 402; thereby providing a form of timing synchronization between the signals for modification.

For the example in FIG. 4, all the audio signals may be digital signals.

In other examples, some audio signals at certain processing steps may be analog or digital. For example, the raw audio stream may be analog or digital. If the raw audio stream is analog, the system converts the raw audio stream into a digital signal so that DSP functions can be applied.

Figure 5:
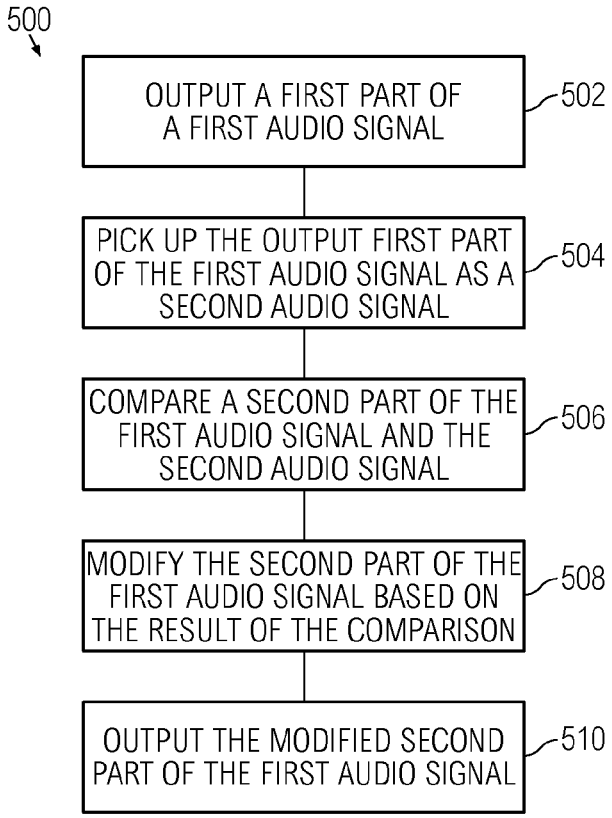
FIG. 5 shows a flow diagram of a method of processing an audio signal, in accordance to various embodiments.

In a first aspect, a method of processing an audio signal 500 is provided as shown in FIG. 5. At 502, a first part of a first audio signal is output. For example, the first part of the first audio signal may refer to the modified audio stream 406 of FIG. 4 and the first audio signal may refer to the raw audio stream 400 of FIG. 4. The first part of the first audio signal refers to an audio signal over a period of time, for example, denoted as X. The term "audio signal" may interchangably be referred to as "audio stream" which may represent any audio signal originating from any audio signal source, for example, a playback audio track.

At 504, the output first part of the first audio signal is picked up as a second audio signal. For example, the second audio signal may refer to the MIC (L/R) audio signal 424 of FIG. 4. As used herein, the term "pick up" or "picked up" may generally refer to being received.

At 506, a second part of the first audio signal and the second audio signal are compared. For example, the second part of the first audio signal may refer to an audio signal based on the raw audio stream 400 of FIG. 4 that is fed through the system 402 with the DSP function 404 and into an input of the comparator 426. In another example (not shown), the second part of the first audio signal may be an audio signal based on the raw audio stream and is fed into an input of the comparator without going through the system with the DSP function.

At 508, the second part of the first audio signal is modified based on the result of the comparison. For example, the result of the comparison refers to the result(s) of the comparison 428 of FIG. 4.

As used herein, the term "modify" refers but is not limited to change, adjust, amplify, or attenuate. For example, the second part of the first audio signal may be modified by amplifying its amplitude based on the result of comparison which may be an amplification correction factor. In another non-limiting example, the second part of the first audio signal may be modified by changing its frequency based on the result of comparison which may be a frequency correction factor. It should be appreciated that modification can take any form of change or a combination of changes in accordance to the result of comparison. Due to the feedback mechanism, the modification may be referred to as an adaptive modification. The object of the modification is to obtain a perceived sound signature at a user's outer ear that matches the original/raw audio stream as closely as possible.

At 510, the modified second part of the first audio signal is output.

For example, the modified second part of the first audio signal may refer to the modified audio stream 406 of FIG. 4 over another period of time, for example, denoted as Y. In one example, the time periods X and Y may be adjacent time periods. In another example, at least parts of the time periods X and Y may be overlapped.

In various embodiments, the steps of outputting at 502, 510, picking up at 504, comparing at 506 and modifying at 508 are repeated at a predetermined time interval that allows substantially real-time processing of the audio signal. For example, after the modified second part of the first audio signal is output at 510, the steps provided by the method 500 may be repeated such that the modified second part of the first audio signal now becomes the first part of the first audio signal at 502. In this case, the first part of the first audio signal now refers to an audio signal over the other period of time, for example, denoted as Y.

The method 500 may be repeated at intervals or may be repeated continuously so as to provide substantially real-time audio signal processing. It should be appreciated and understood that the term "substantially" may include "exactly" and "similar" which is to an extent that it may be perceived as being "exact". For illustration purposes only and not as a limiting example, the term "substantially" may be quantified as a variance of +/−5% from the exact or actual. For example, the phrase "A is (at least) substantially the same as B" may encompass embodiments where A is exactly the same as B, or where A may be within a variance of +/−5%, for example of a value, of B, or vice versa.

In various embodiments, the step of outputting the first part of the first audio signal at 502 may include outputting the first part of the first audio signal through a speaker of a headset.

In the context of various embodiments, the term "headset" may refer to a device having one or more earphones usually with a headband for holding them over the ears of a user. In some examples, the term "headset" may interchangably refer to headphone, ear piece, ear phone, or receiver.

In an example, a headset includes ear phones in the form of ear cups, for example, the ear cups 408, 410 of FIG. 4. Each ear cup may include a cushion that surrounds the peripheral circumference of the ear cup. When a user places the ear cup over the ear, the cushion covers the ear to provide an enclosed environment around the ear in order for an audio signal to be directed into the auditory canal of the ear.

As used herein, the term "speaker" generally refers to an audio transmitter of any general form and may be interchangably referred to as a loudspeaker. The speaker may include an audio driver. The speaker may be encased within the ear cup of the headset.

In various embodiments, the step of picking up the output first pan of the first audio signal as the second audio signal at 504 may include receiving the output first part of the first audio signal by a microphone. The microphone may be strategically positioned within the ear cup such that the microphone receives the maximum level of audio signal and/or the microphone receives the similar audio signal as received by the ear canal of a wearer of the headset.

As used herein, the term "microphone" generally refers to an audio receiver of any general form. For example, the microphone may be a microelectromechanical system (MEMS) microphone. A MEMS microphone is generally a microphone chip or silicon microphone. To form the MEMS microphone, a pressure-sensitive diaphragm is etched directly into a silicon chip by MEMS techniques, and is usually accompanied with integrated preamplifier. Most MEMS microphones are variants of the condenser microphone design. Often MEMS microphones have built in analog-to-digital converter (ADC) circuits on the same CMOS chip making the chip a digital microphone and so more readily integrated with digital products. The MEMS microphone is typically compact and small in size, and can receive audio signals across a wide angle of transmission. The MEMS microphone also has a flat response over a wide range of frequencies.

In various embodiments, the microphone may be located within an ear cup of the headset such that when a wearer wears the headset, the microphone may be configured to be positioned substantially near the entrance of the ear canal of the wearer.

As used herein, the term "wearer" may interchangably be referred to as the user. The term "substantially" may be as defined above. In this context, the term "near" refers to being in close proximity such that the microphone and ear canal both receive at least similar audio signals. The term "ear canal" refers to the auditory canal of the ear.

In various embodiments, the second audio signal may include a left channel audio signal and a right channel audio signal of the headset. For example, the left channel audio signal and the right channel audio signal may refer to MIC (L/R) audio signal 424 of FIG. 4.

In an embodiment, the second audio signal may further include a noise signal.

As used herein, the phrase "noise signal" generally refers to any undesired signals which may include unwanted audio signals and/or electrical noise signals that is attributed by the various electronic components (eg. microphone or electrical conductor). Electrical noise signals may include, for example, crosstalk, thermal noise, shot noise. Unwanted audio signals may include, for example, sounds from the environment.

In various embodiments, the output first part of the first audio signal may include a reflection of the first part of the first audio signal. In the context of various embodiments, the term "reflection" refers to an echo.

In an embodiment, the reflection of the first part of the first audio signal may include a reflection of the first part of the first audio signal from at least part of a pinna of a wearer of the headset. The reflected signal may be conditioned by processing for echo and noise cancellation correction factors.

As used herein, the term "pinna" means the outer ear structure that form one's unique ear shape.

For example, when a wearer (or user) wears the headset, the audio signal is output from the speaker of the headset and travels to the ear. Parts of the audio signal may enter into the ear canal while other parts of the audio signal may reach the pinna of the ear. The other parts of the audio signal or parts thereof may bounce off or reflect from the surface of the pinna and may be picked up by the microphone.

In another example, parts of the audio signal may enter into the ear canal while other parts of the audio signal may reach a surface of the ear cup that forms an at least substantially enclosed area with the ear. The other parts of the audio signal or parts thereof may bouce off or reflect from this surface of the ear cup and may be picked up by the microphone.

In various embodiments, the step of comparing the second part of the first audio signal and the second audio signal at 506 may include comparing at least one of the amplitude of the second part of the first audio signal and the amplitude of the second audio signal to obtain an amplitude correction factor, the frequency of the second part of the first audio signal and the frequency of the second audio signal to obtain a frequency correction factor, or the phase of the second part of the first audio signal and the phase of the second audio signal to obtain a phase correction factor.

For example, the amplitude correction factor, the frequency correction factor, and/or the phase correction factor may be the result(s) of the comparison 428 of FIG. 4.

The term "comparing" may refer but is not limited to taking the difference of two or more signals. For example, the term "comparing" may also include a weight or a multiplication factor applied on the difference.

In various embodiments, the step of modifying the second part of the first audio signal at 508 may include modifying the second part of the first audio signal based on at least one of the amplitude correction factor, the frequency correction factor or the phase correction factor. For example, the second part of the first audio signal may be modified based on the amplitude correction factor, or the frequency correction factor, or the phase correction factor, or the combination of the amplitude correction factor and the frequency correction factor, or the combination of the amplitude correction factor and the phase correction factor, or the combination of the phase correction factor and the frequency correction factor, or the combination of the amplitude correction factor and the frequency correction factor and the phase correction factor.

In various embodiments, the step of modifying the second part of the first audio signal at 508 may include increasing or decreasing at least one of the amplitude, the frequency or the phase of the second part of the first audio signal.

In various embodiments, the step of modifying the second part of the first audio signal at 508 may include modifying the second part of the first audio signal based on a Head Related Transfer Function (HRTF).

In the context of various embodiments, a head-related transfer function (HRTF) is a response that characterizes how an ear receives a sound from a point in space. A pair of HRTFs for two ears may be used to synthesize a binaural sound that seems to come from a particular point in space. In general, HRTF is a transfer function describing how a sound from a specific point arrives at the ear or the pinna.

In various embodiments, the second part of the first audio signal is modified based on a dynamic HRTF. In other words, the dynamic HRTF changes according to severals factors, for example, a change in the position of the ear and/or a change in the received audio signal. This is in contrast to existing HRTFs which are static and do not change. For example, existing stereo sound systems may use static HRTF for their respective signal processing.

In various embodiments, the method 500 may further include prior to comparing the second part of the first audio signal and the second audio signal at 506, a delay may be added to the second part of the first audio signal.

The delay may be performed by a phase shifter such as the phase shifter 430 of FIG. 4. The purpose of adding a delay is to provide a form of timing synchronization between the two signals for comparsion such that the second audio signal may be compared against the corresponding part of the first audio signal.

In various embodiments, the method 500 may further include prior to modifying the second part of the first audio signal at 508, another delay may be added to the result of the comparison.

The other delay may be performed by a phase shifter such as the phase shifter 432 of FIG. 4. The purpose of adding the other delay is to provide a form of timing synchronization between the signals for modification such that the second part of the first audio signal may be modified based on the corresponding result of the comparison.

In various embodiments, the second part of the first audio signal may be an analog signal or a digital signal. If the second part of the first audio signal is an analog signal, the method 500 may further include converting the analog second part of the first audio signal into a digital signal. The digital signal may be in any format, for example, represented by parallel bits or serial bits and may be of any resolution, for example but not limited to 8-bit representation, 16-bit representation, 32-bit representation, 64-bit representation, or other representations higher than 64-bit representation.

Figure 6:
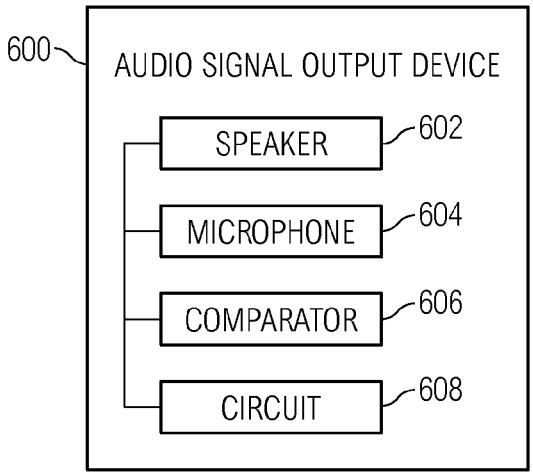
FIG. 6 shows a schematic block diagram of an audio signal output device, in accordance to various embodiments.

In a second apsect, an audio signal output device 600 is provided as shown in FIG. 6. The audio signal output device 600 includes a speaker 602 configured to output a first part of a first audio signal; a microphone 604 configured to pick up the output first part of the first audio signal as a second audio signal; a comparator 606 configured to compare a second part of the first audio signal and the second audio signal; and a circuit 608 configured to modify the second part of the first audio signal based on the result of the comparison, wherein the speaker 602 is further configured to output the modified second part of the first audio signal.

For example, the speaker 602 may be the respective speaker found in the left and right ear cups 408, 410 of FIG. 4. The microphone 604 may be as defined hereinabove and may be the microphone MIC "L" 420 or the microphone MIC "R" 422 of FIG. 4. The comparator 606 may refer to the comparator 426 of FIG. 4. The comparator 606 may be a summing circuit and may be a digital comparator (i.e., a comparator comparing digital signals). The circuit 608 may refer to the system 402 of FIG. 4 with the DSP function 404.

In other examples, the circuit 608 may be integrated within the ear cup, for example, the left and/or right ear cups 408, 410 of FIG. 4.

In the context of various embodiments, a "circuit" may be understood as any kind of a logic implementing entity, which may be special purpose circuitry or a processor executing software stored in a memory, firmware, or any combination thereof. Thus, a "circuit" may be a hard-wired logic circuit or a programmable logic circuit such as a programmable processor, e.g. a microprocessor (e.g. a Complex Instruction Set Computer (CISC) processor or a Reduced Instruction Set Computer (RISC) processor). A "circuit" may also be a processor executing software, e.g. any kind of computer program, e.g. a computer program using a virtual machine code such as e.g. Java or e.g. digital signal processing algorithm. Any other kind of implementation of the respective functions which are described may also be understood as a "circuit" in accordance with an alternative aspect of this disclosure.

In various embodiments, the speaker 602, the microphone 604, the comparator 606 and the circuit 608 may be configured to operate repetitively at a predetermined time interval that allows substantially real-time audio signal processing.

The term "substantially" is as defined above. The term "real-time" means a time-frame in which an operation is performed that is acceptable to and perceived by a user to be similar or equivalent to actual clock times. "Real-time" may also refer to a deterministic time in response to real world events or transactions where there is no strict time related requirement. For example, in this context, "real-time" may relate to operations or events occuring in microseconds, milliseconds, seconds, or even minutes ago.

In an example, the predetermined time interval may be but is not limited to a range of about 1 μs to about 100 μs, or about 10 μs to about 50 μs, about 1 ms to about 100 ms, or about 10 ms to about 50 ms, about 1 s to about 10 s.

The term "repetitively" refers to performing over and over.

The terms "microphone", "first part of the first audio signal", "second audio signal", "second part of the first audio signal", "compare", "modify", "result of the comparison" and "modified second part of the first audio signal" may be as defined above.

In various embodiments, the comparator 606 may be configured to compare at least one of the amplitude of the second part of the first audio signal and the amplitude of the second audio signal to obtain an amplitude correction factor, the frequency of the second part of the first audio signal and the frequency of the second audio signal to obtain a frequency correction factor, or the phase of the second part of the first audio signal and the phase of the second audio signal to obtain a phase correction factor.

The phrases "amplitude correction factor", "frequency correction factor" and "phase correction factor" may be defined as above.

In various embodiments, the circuit 608 may be configured to modify the second part of the first audio signal based on at least one of the amplitude correction factor, the frequency correction factor or the phase correction factor. For example, the circuit 608 may be configured to increase or decrease at least one of the amplitude, the frequency or the phase of the second part of the first audio signal. The circuit 608 may also be configured to modify the second part of the first audio signal based on a Head Related Transfer Function (HRTF).

The phrase "HRTF" may be as defined above.

In various embodiments, the audio signal output device 600 may further include a phase shifter configured to add a delay to the second part of the first audio signal.

In other embodiments, the audio signal output device 600 may further include another phase shifter configured to add another delay to the result of the comparison.

The phase shifter and the other phase shifter may refer to the phase shifter 430 and the phase shifter 432 of FIG. 4, respectively. The phase shifter (or delay block) may be used if there is a phase or delay measured as a result of the signal going through the various components or devices during processing.

In various embodiments, the audio signal output device 600 may further include an analog-to-digital converter configured to convert the analog second part of the first audio signal into a digital signal.

Figure 7:
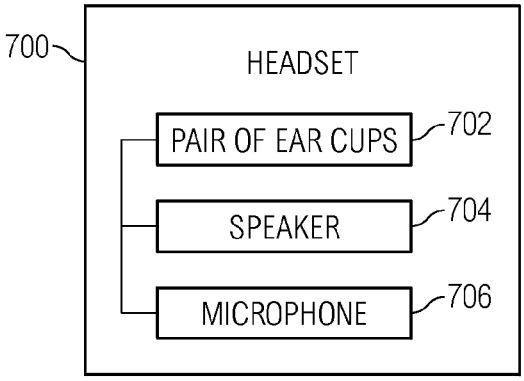
FIG. 7 shows a schematic block diagram of a headset, in accordance to various embodiments, in accordance to various embodiments.

In a third aspect, a headset 700 is provided as shown in FIG. 7. The headset 700 includes a pair of ear cups 702; a speaker 704 located in each ear cup 702; and a microphone 706 located within at least one of the pair of the ear cups 702, wherein the speaker 704 is substantially centrally located with the ear cup 702; and wherein the microphone 706 is located adjacent to the speaker 704.

The term "adjacent" refers to neighbouring, next to or alongside.

For example, the pair of ear cups 702 may refer to the left and right ear cups 408, 410 of FIG. 4, the speaker 704 may be the respective speaker found in the left and right ear cups 408, 410 of FIG. 4, and the microphone 706 may be the microphone MIC "L" 420 and/or the microphone MIC "R" 422 of FIG. 4.

In various embodiments, the microphone 706 may be located below the speaker 704 such that when a wearer wears the headset, the microphone 706 is configured to face a substantially lower part of the external auditory canal of the wearer.

As used herein, the phrase "external auditory canal" may interchangably be referred to as ear canal or auditory canal.

In an embodiment, the microphone 706 may be located within an area having a radius of about 1 cm to 2 cm from the substantially centrally located speaker 704. In other examples, the microphone 706 may be located about 0.5 cm, about 1 cm, about 1.2 cm, about 1.5 cm, about 1.8 cm, about 2 cm, about 2.2 cm, or about 2.5 cm from the substantially centrally located speaker 704.

In some embodiments, the headset 700 may include a plurality of speakers in each ear cup. For example, the headset 700 may include 2 or 3 or 4 or 5 speakers in each ear cup.

The term "microphone" may be as defined above.

Various embodiments provide an adaptive method and device that adjusts the (original) raw audio stream, e.g. the raw audio stream 400 in FIG. 4 in real-time, allowing for altering the (original) raw audio stream in such a way as to give the listener (wearer) the perception regardless of the position of audio driver in relation to the outer ear and its unique shape that the audio content is whole, intact and retains the intended sound signature.

The real-time adaptive part of the approach, for example as described in FIG. 3 may be based on a unique combination of specific HW driver frequency corrections specific to the headset and a SW wave synthesis algorithm that adjusts in real-time other critical audio factors for example phase, delay, signal amplitude, (attenuation/amplification) factors based on a comparison to the initial audio signal. In some examples, both the correction and algorithm may take place in a system with DSP function(s), for example, the system 402 of FIG. 4.

Figure 1:
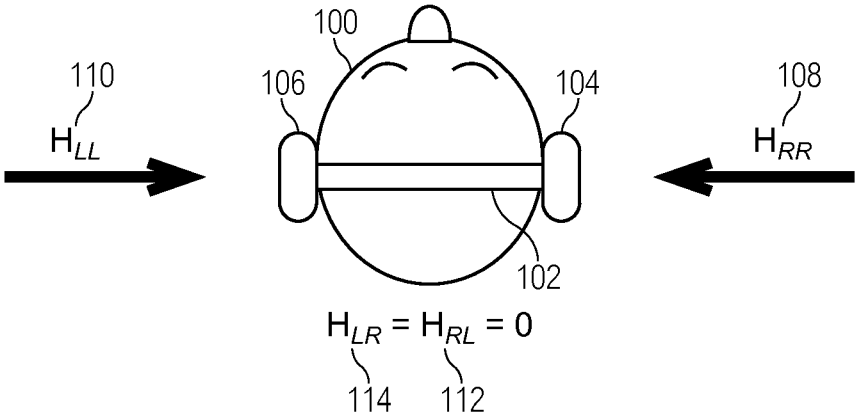
FIG. 1 shows a top view of a schematic diagram of a user wearing a headphone (or headset) and the HRTFs thereof.
Figure 2:
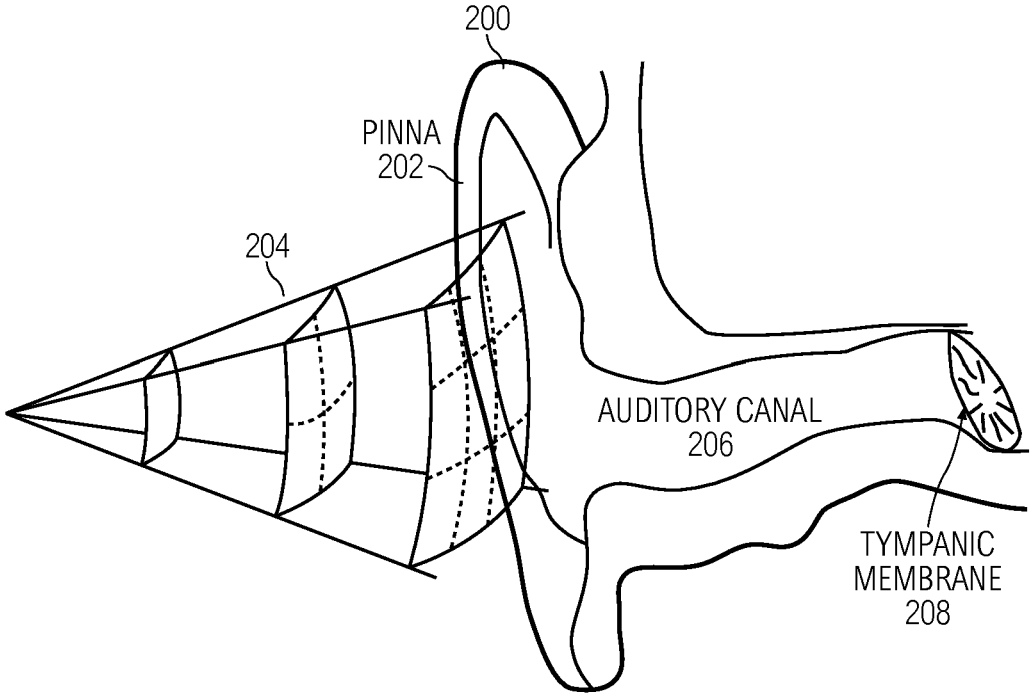
FIG. 2 shows a schematic diagram of a listener's ear.

By way of strategic and optimized placement of the digital silicon or MEMs microphone near the entry of the ear cannel leading to the tympanic membrane as depicted in FIG. 2 and at a distance that allows the microphone to pick up key audio impulses from the outer ear or pinna, the adaptive method and device for processing the audio signal may be achieved.

Figure 8A:
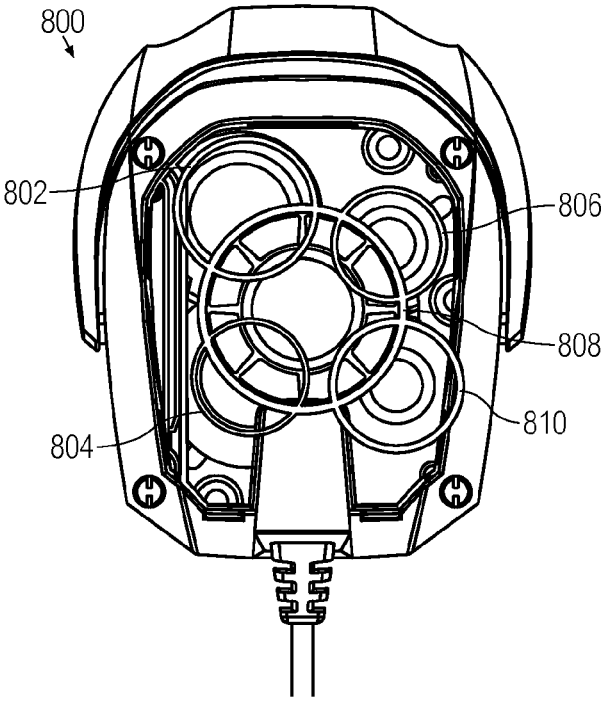
FIG. 8A shows a cross-sectional side view of an exemplary ear cup of a headset, in accordance to various embodiments.

FIG. 8A shows a cross-sectional side view of an exemplary ear cup 800 of a headset. In this example, five speakers 802, 804, 806, 808 and 810 are shown to be located within the ear cup 800 with speaker 808 being substantially centrally located in the ear cup 800. The rest of the speakers 802, 804, 806 and 810 are positioned around the central speaker 808. For example, speaker 802 is positioned top-left to speaker 808; driver 804 is positioned bottom-left to speaker 808; driver 806 is positioned top-right to speaker 808; and driver 810 is positioned bottom-right to speaker 808.

Figure 8B:
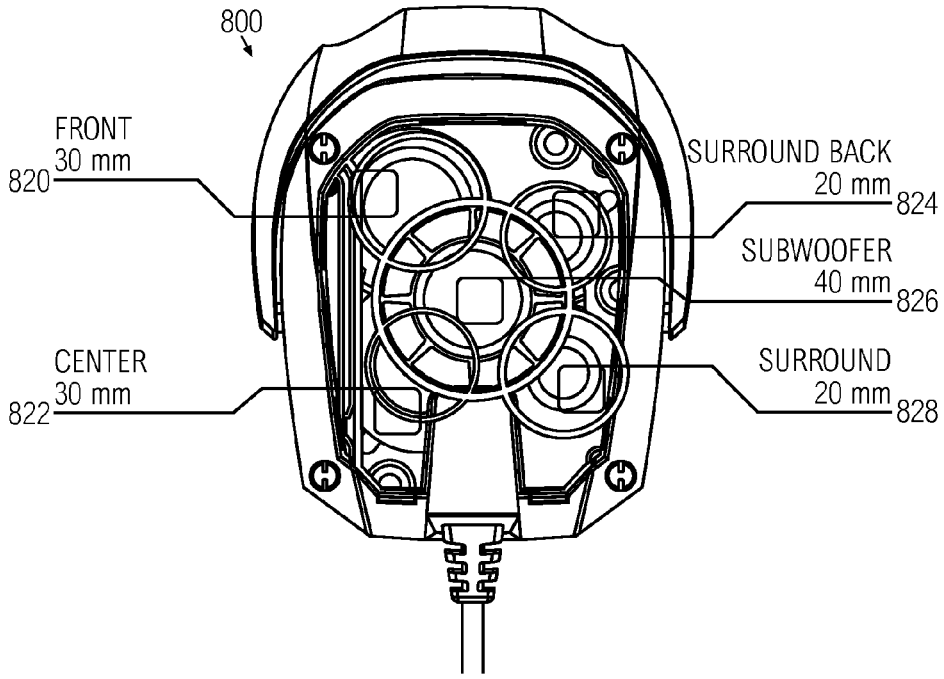
FIG. 8B shows a cross-sectional side view of an exemplary ear cup of a headset depicting the positions of various drivers, in accordance to various embodiments.

FIG. 8B shows the exemplary ear cup 800 of FIG. 8A depicting the positions of various drivers.

In FIG. 8B, five (audio) drivers 820, 822, 824, 826, 828 are located at the respective speakers 802, 804, 806, 808, 810. When a wearer wears the headset with the ear cup 800 over the ear resulting in the upright orientation of the ear cup 800 as shown in FIG. 8B, the wearer faces to the left and the ear cup 800 is the left ear cup for the wearer. Driver 820 may be a front driver with a diameter of about 30 mm; driver 822 may be a center driver with a diamater of about 30 mm; driver 824 may be a surround back driver with a diameter of about 20 mm; driver 826 may be a subwoofer driver with a diameter of about 40 mm; and driver 828 may be a surround driver with a diameter of about 20 mm.

Figure 8C:
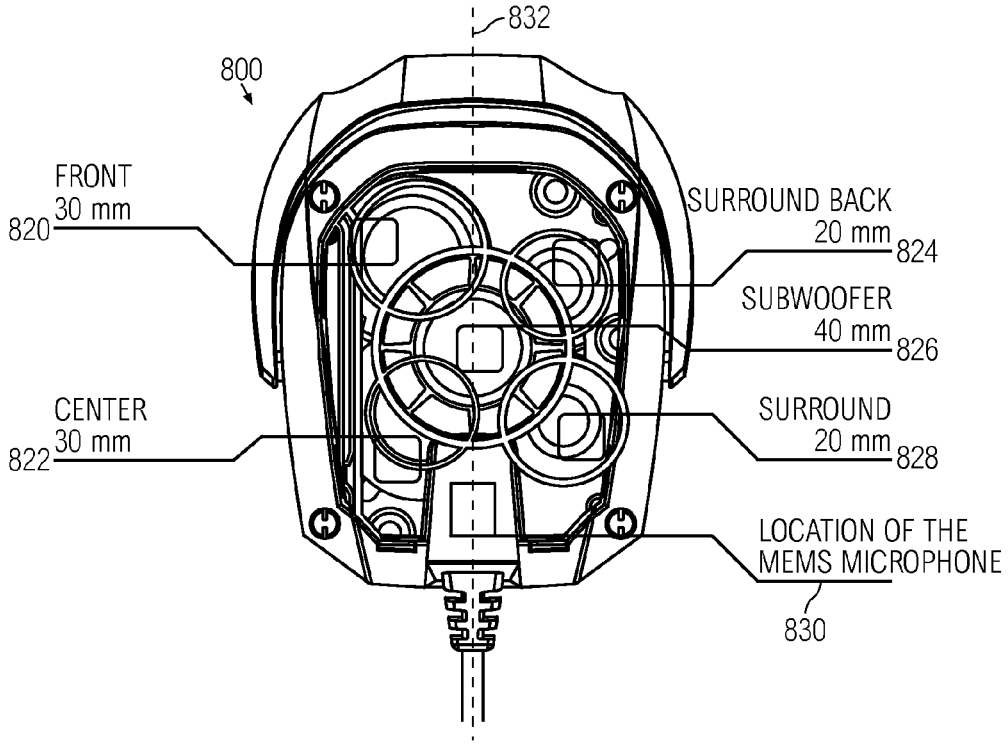
FIG. 8C shows a cross-sectional side view of an exemplary ear cup of a headset depicting a preferred (or ideal) position of the MEMS microphone, in accordance to various embodiments.

FIG. 8C shows the exemplary ear cup 800 of FIG. 8A depicting the preferred (or ideal) position of the MEMS microphone 830. In FIG. 8C, the MEMS microphone is positioned along the central axis 832 and near the bottom of the ear cup 800, that is, below the center driver 822 and the surround driver 828.

Figure 8D:
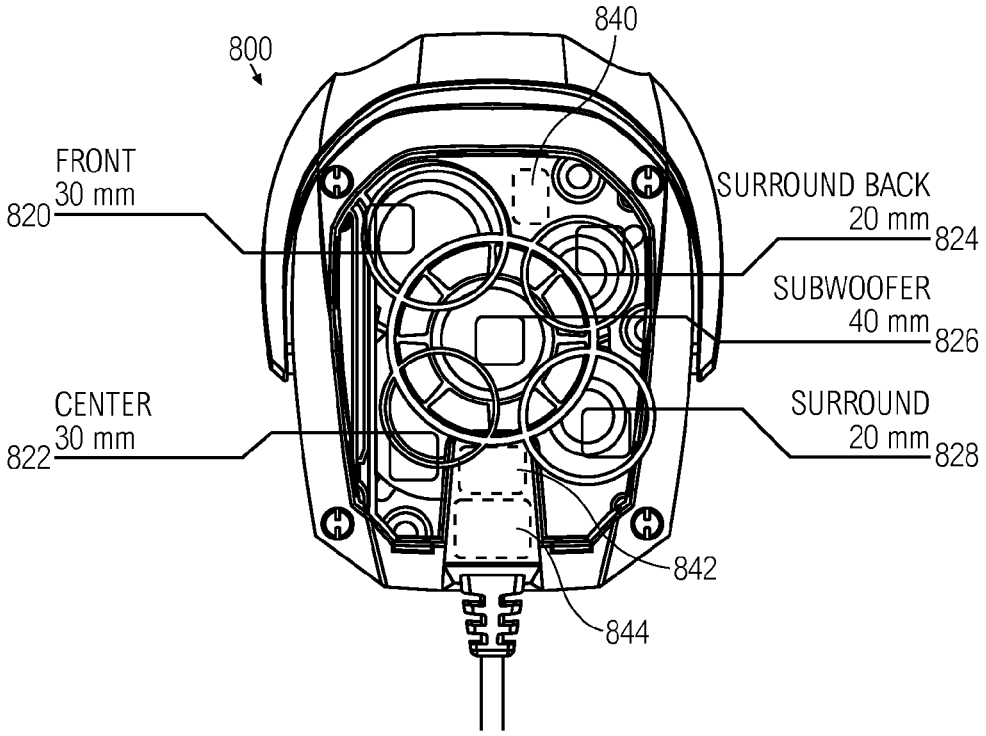
FIG. 8D shows a cross-sectional side view of an exemplary ear cup of a headset depicting possible areas where a MEMS microphone may be located and the effects thereof, in accordance to various embodiments.

FIG. 8D shows the exemplary ear cup 800 of FIG. 8A depicting three possible areas 840, 842, 844 where a MEMS microphone may be located and the effects thereof.

For example, having the MEMS microphone located in the area 840 is non-ideal as the area 840 is located furthest from the ear canal of the wearer. The MEMS microphone located in the area 842 allows adaptive audio signal processing to work and is better as compared to being located in the area 840. Having the MEMS microphone located in the area 844 is (most) ideal since the area 844 is located nearest to the ear canal of the wearer.

The method according to various embodiments as described above may adapt itself more to audio listening environment especially at the micro level (for example, at the inlet to the ear as the audio signal (or sound) enters the outer ear) where there are inherent differences in the surface (that is provided by the shape of a user's outer ear or pinna and inner ear canal) that channels the audio signal or sound to the tympanic membrane. The described method also can take into account the ambient noise levels and applying noise cancellation approaches that are different depending upon the listening environment. In contrast, existing HRTF functions are static in nature and cannot account for or correct for these eventualities/environmental factors.

Figure 9:
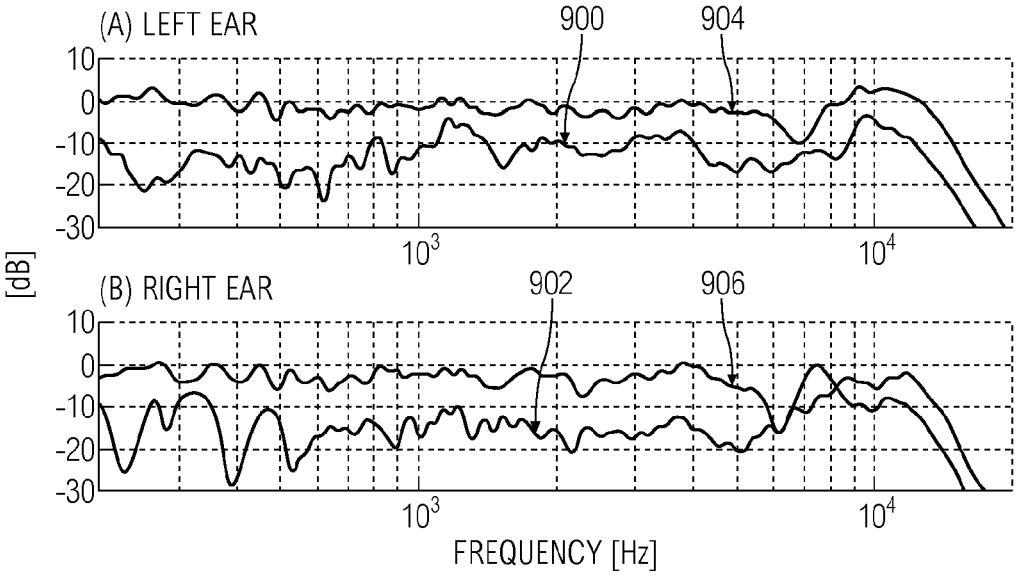
FIG. 9 shows modified audio signals based on an amplitude correction factor and corresponding original audio signals over the frequency range of 100 Hz to 20 KHz for (A) the left ear and (B) the right ear, in accordance to various embodiments.

By applying the described method, a comparison between a modified audio signal and the corresponding original audio signal was made. FIG. 9 shows the modified audio signals 900, 902 based on an amplitude correction factor and the corresponding original audio signals 904, 906 over the frequency range of 100 Hz to 20 KHz for (A) the left ear and (B) the right ear. It is noted that an inherent difference of about 4 dB to about 8 dB between the right and left ear.

As seen in FIG. 9, the modified audio signals 900, 902 are attenuated from the original audio signals 904, 906 based on the amplitude correction factor. A user preceives the original audio signals 904, 906 when wearing a headset outputting the modified audio signals 900, 902. Conclusively, FIG. 9 shows an example of an original audio wave and the resulting wave after wave synthesis or correction factors have been applied.

In the context of various embodiments, the term "about" as applied to a numeric value encompasses the exact value and a variance of +/−5% of the value.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method of processing an audio signal comprising:

processing a first audio signal based on an adaptive filter;

outputting the processed first audio signal through a speaker of a headset as an output signal;

picking up a second audio signal with a microphone, the second audio signal comprising a reflection of the output signal from a pinna of a wearer of the headset;

generating a desired audio signal based on the first audio signal and a desired transfer function;

delaying the desired audio signal;

comparing the delayed desired audio signal and the second audio signal; and modifying the adaptive filter based on the comparison and further based on a head-related transfer function.

2. The method of claim 1, wherein the steps of outputting, picking up, generating, delaying, comparing and modifying are repeated at a predetermined time interval that allows substantially real-time processing of the audio signal.

3. The method of claim 1, wherein the microphone is located within an ear cup of the headset such that when the wearer wears the headset, the microphone is configured to be positioned substantially near the entrance of the ear canal of the wearer.

4. The method of claim 1, wherein the second audio signal comprises a left channel audio signal and a right channel audio signal of the headset.

5. The method of claim 1, wherein the second audio signal further comprises a noise signal.

6. An audio signal output device comprising:

an adaptive filter configured to process a first audio signal;

a speaker configured to receive the processed first audio signal and further configured to output an output signal;

a microphone configured to pick up a reflection of the output signal as a second audio signal, the second audio signal comprising a reflection of the output signal from a pinna of a wearer of the headset;

a processor configured to generate a desired signal based on the first audio signal and a desired transfer function;

a phase shifter configured to delay the desired signal;

a comparator configured to compare the delayed desired audio and the second audio signal; and a circuit configured to modify the adaptive filter based on the comparison and further based on a head-related transfer function.

7. The audio signal output device of claim 6, wherein the microphone is a microelectrical-mechanical system (MEMS) microphone.

8. The audio signal output device of claim 6, wherein the comparator is configured to compare at least one of an amplitude of the delayed desired signal and an amplitude of the second audio signal to obtain an amplitude correction factor, the frequency of the delayed desired signal and the frequency of the second audio signal to obtain a frequency correction factor, or a phase of the delayed desired signal and a phase of the second audio signal to obtain a phase correction factor.

9. The audio signal output device of claim 8, wherein the circuit is configured to modify the adaptive filter based on at least one of the amplitude correction factor, the frequency correction factor or the phase correction factor.

10. The audio signal output device of claim 6, wherein the circuit is configured to increase or decrease at least one of an amplitude, a frequency or a phase of a processed further audio signal, the processed further audio signal being a further audio signal processed by the adaptive filter.

11. The audio signal output device of claim 6, further comprising another phase shifter configured to add another delay to a result of the comparison.

12. The audio signal output device of claim 6, further comprising an analog-to-digital converter configured to convert the processed first audio signal into a digital signal.

13. A headset comprising:

a pair of ear cups;

a speaker located in each ear cup; and a microphone located within at least one of the pair of the ear cups, wherein the speaker is substantially centrally located with the ear cup;

wherein the microphone is located adjacent to the speaker; and wherein the headset comprises a plurality of speakers in each ear cup;

wherein the microphone is configured to receive audio impulses from a pinna of a wearer of the headset;

wherein the speaker is configured to provide audio signals based on the received audio impulses and further based on a head-related transfer function.

14. The headset of claim 13, wherein the microphone is located below the speaker such that when the wearer wears the headset, the microphone is configured to face a substantially lower part of the external auditory canal of the wearer.

15. The headset of claim 14, wherein the microphone is located within an area having a radius of about 1 cm to 2 cm from the substantially centrally located speaker.

16. The headset of claim 13, wherein the microphone is a microelectromechanical system (MEMS) microphone.

17. The headset of claim 13, wherein in each ear cup, the microphone is positioned along a central axis of the ear cup and at a bottom of the ear cup.

* * * * *